US010967530B2

(12) United States Patent
Eijkelkamp et al.

(10) Patent No.: US 10,967,530 B2
(45) Date of Patent: Apr. 6, 2021

(54) HAIR CUTTING DEVICE

(71) Applicant: KONINKLIJKE PHILIPS N.V., Eindhoven (NL)

(72) Inventors: Marcus Franciscus Eijkelkamp, Peize (NL); Martijn Frans Johan Nab, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/344,992

(22) PCT Filed: Sep. 28, 2018

(86) PCT No.: PCT/EP2018/076444
§ 371 (c)(1),
(2) Date: Apr. 25, 2019

(87) PCT Pub. No.: WO2019/063784
PCT Pub. Date: Apr. 4, 2019

(65) Prior Publication Data

US 2020/0215707 A1 Jul. 9, 2020

(30) Foreign Application Priority Data

Sep. 29, 2017 (EP) ..... 17194014

(51) Int. Cl.
*B26B 19/20* (2006.01)
*B26B 19/38* (2006.01)

(52) U.S. Cl.
CPC ..... *B26B 19/205* (2013.01); *B26B 19/38* (2013.01)

(58) Field of Classification Search
CPC ..... B26B 19/205; B26B 19/38; B26B 19/02; B26B 19/046; B26B 19/048; B26B 19/063; B26B 19/20
USPC ..... 30/43.7–43.92, 194–204, 208–220; D28/44–54
See application file for complete search history.

(56) References Cited

U.S. PATENT DOCUMENTS 2,726,447 A * 12/1955 Maloy ..... B26B 19/205 30/202
2,731,720 A * 1/1956 Henard ..... B26B 19/20 30/201
2,941,293 A * 6/1960 Mazzoni ..... B26B 19/20 30/201

(Continued)

OTHER PUBLICATIONS

International Search Report/Written Opinion dated Dec. 20, 2018.

*Primary Examiner* — Jason Daniel Prone

(57) ABSTRACT

A hair cutting device includes a cutter having a guard moveable relative a blade carrier to vary a cutting length within a cutting length range. The cutter has an actuator moveable between first and second positions to move a follower element and the guard to vary the cutting length between two extreme length settings. The cutter is pivotable relative a housing of the cutting device between an open position and a closed position for cutting. The follower element is configured to cooperate with the actuator so that, when the cutter is in the open position with the follower element and guard in the first position, but the actuator is in the second position, pivoting movement of the cutter to the closed position causes the actuator to drive the follower element and the guard to the second position.

18 Claims, 4 Drawing Sheets

(56) References Cited

U.S. PATENT DOCUMENTS 3,237,304 A * 3/1966 Merzon ..... B26B 19/20 30/201
3,280,456 A * 10/1966 Erickson ..... B26B 19/205 30/133
3,287,805 A * 11/1966 Du Charme ..... B26B 19/20 30/202
3,430,342 A * 3/1969 Wahl ..... B26B 19/205 30/201
3,531,862 A * 10/1970 Bender ..... B26B 19/205 30/201
4,581,822 A * 4/1986 Fujimura ..... B26B 19/063 30/201
4,776,095 A * 10/1988 Tsujimoto ..... B26B 19/20 30/201
4,825,546 A * 5/1989 Araki ..... B26B 19/06 30/201
5,054,199 A * 10/1991 Ogawa ..... B26B 19/06 30/200
5,084,974 A * 2/1992 Sukow ..... B26B 19/20 30/201
5,325,589 A * 7/1994 Kubo ..... B26B 19/205 30/195
5,367,772 A * 11/1994 Ogawa ..... B26B 19/205 30/201
5,970,616 A * 10/1999 Wahl ..... B26B 19/063 30/199
6,260,276 B1 * 7/2001 Lebherz ..... B26B 19/205 30/200
6,536,116 B2 * 3/2003 Fung ..... B26B 19/063 30/199
6,578,269 B2 * 6/2003 Wilcox ..... B26B 19/20 30/201
6,684,507 B2 * 2/2004 Lau ..... B26B 19/063 30/122
6,742,262 B2 * 6/2004 Rizzuto, Jr. ..... B26B 19/205 30/201
6,935,028 B2 * 8/2005 Cutting ..... B26B 19/06 30/41.5
6,968,623 B2 * 11/2005 Braun ..... B26B 19/20 30/201
7,234,242 B2 * 6/2007 Yao ..... B26B 19/06 30/201
7,367,127 B2 * 5/2008 Nakakura ..... B26B 19/20 30/201
7,509,743 B2 * 3/2009 Oh ..... B26B 19/20 30/200
7,703,210 B2 * 4/2010 Lau ..... B26B 19/205 30/196
7,748,123 B2 * 7/2010 Bednar ..... B26B 19/02 30/210
7,992,303 B2 * 8/2011 Liao ..... B26B 19/205 30/200
8,341,846 B1 * 1/2013 Holmes ..... B26B 19/205 30/210
9,144,911 B2 * 9/2015 Arndt ..... B26B 19/28
9,352,476 B1 5/2016 Holmes
9,545,729 B2 * 1/2017 Buck, Jr. ..... B26B 19/063
9,815,215 B2 * 11/2017 Uit De Bulten ..... B26B 19/205
9,993,928 B2 * 6/2018 Sablatschan ..... B26B 19/06
10,040,208 B2 * 8/2018 Darwinkel ..... B26B 19/20
10,456,936 B2 * 10/2019 Darwinkel ..... B26B 19/20
2005/0246902 A1 * 11/2005 Poran ..... B26B 19/20 30/201
2007/0044320 A1 * 3/2007 Fukutani ..... B26B 19/205 30/201
2008/0066314 A1 * 3/2008 Rapold ..... B26B 19/20 30/30
2008/0282550 A1 * 11/2008 Piwaron ..... B26B 19/06 30/210
2008/0295340 A1 * 12/2008 Carlucci ..... B26B 19/063 30/199
2014/0331503 A1 * 11/2014 Uit De Bulten ..... B26B 19/20 30/201
2017/0341245 A1 * 11/2017 Nayna ..... B26B 19/063
2020/0189135 A1 * 6/2020 Peterson, Jr. ..... B26B 19/063

* cited by examiner

HAIR CUTTING DEVICE

This application is the U.S. National Phase application under 35 U.S.C. § 371 of International Application No. PCT/EP2018/076444, filed on Sep. 28, 2018, which claims the benefit of European Application No. 17194014.1 filed on Sep. 29, 2017. These applications are hereby incorporated by reference herein.

FIELD OF THE INVENTION

The disclosure relates to a hair cutting device.

BACKGROUND OF THE INVENTION

Known hair cutting devices, such as beard trimmers and clippers, typically comprise a handle which houses bulky components such as batteries and drive system, and a cutting unit attached to the handle. In known cutting units, a toothed cutting blade engages a blade-facing surface of a guard, and can be driven to reciprocate over slots in the guard. In use, either the guard or a comb attached to the guard contacts the skin of the user.

In some cutting units, the guard may be moveable relative to the cutting blade to vary the cutting length. An adjustment means may be provided on the cutting unit, or in the handle for easier control by a user. For example, an adjustment means in the form of an actuating lever may be provided in the handle to drive movement of the guard in the cutting unit. It may be desirable to provide an adjustment means which locks the cutting unit at a selected cutting length during use.

Cutting units may be partially or wholly detachable from a handle, for example for cleaning, maintenance and replacement.

SUMMARY OF THE INVENTION

In a broad aspect the disclosure relates to a hair cutting device having a variable cutting length range which permits a moveable actuator of a housing unit of the device to engage a moveable follower element of a cutting unit of the device, even when the actuator and the follower element having non-corresponding starting positions.

According to a first aspect there is provided a hair cutting device comprising a housing unit and a cutting unit. The housing unit comprises an actuator for varying a cutting length of the cutting unit within a cutting length range, the actuator being moveable between a first actuator position corresponding to a first extreme cutting length of the cutting length range, and a second actuator position corresponding to a second extreme cutting length of the cutting length range. The cutting unit is configured to pivot relative the housing unit between a closed position for a cutting operation and an open position. The cutting unit comprises: a blade carrier carrying a cutting blade; a guard moveable along the blade carrier to extend the cutting length of the cutting unit within the cutting length range, wherein the guard is moveable between a first guard position corresponding to the first extreme cutting length and a second guard position corresponding to the second extreme cutting length, wherein the guard is biased to the first guard position; a follower element attached to the guard and configured to cooperate with the actuator so that, with the cutting unit in the closed position, movement of the actuator from the first actuator position to the second actuator position drives the follower element to move the guard from the first guard position to the second guard position; wherein the follower element is configured to cooperate with the actuator so that, when the actuator is in the second actuator position, pivoting movement of the cutting unit from the open position to the closed position causes the actuator to drive the follower element to move the guard from the first guard position to the second guard position.

Accordingly, despite the guard being biased to the first guard position so that it returns to the first guard position when in an open position, the follower element is configured to engage the actuator irrespective of the position of the actuator. Accordingly, the cutting unit may be pivoted between the closed position and the open position with the actuator in any actuator position between the first and second actuator positions. Pivoting movement of the cutting unit to the open position may be beneficial to enable maintenance, cleaning or replacement of components of the cutting unit. In some examples, the cutting unit is detachable and replaceable. Accordingly, the configuration element enables a cutting unit to be successfully coupled to the housing unit so that the actuator engages the follower element, irrespective of the position of the actuator and without any previous alignment of the cutting unit to match the actuator position.

The second guard position may correspond to a maximum (or longest) cutting length of the cutting unit. Correspondingly, the first guard position may correspond to a minimum (or shortest) cutting length of the cutting unit. By biasing the guard to a first guard position corresponding to the shortest cutting length, the relative position of the guard and the blade on the blade carrier can be set with relatively high accuracy for the shortest cutting length.

The follower element may be configured to cooperate with the actuator so that, when the actuator is in the second actuator position, pivoting movement of the cutting unit from the open position to the closed position causes an actuation point of the actuator to engage and move along a contact surface of the follower element as the cutting unit moves towards the closed position. The contact surface may be configured so that said movement of the actuation point along the contact surface drives the follower element to move the guard from the first guard position to the second guard position.

The follower element may be configured to move together with the guard relative to the blade carrier along an extension axis of the guard corresponding to extension of the cutting length of the cutting unit. This may provide a particularly simple arrangement for translating movement of the follower element to movement of the guard.

The cutting device may define a pivot axis for pivoting movement of the cutting unit relative the housing unit. The pivot axis may be orthogonal to the extension axis. There may be an extension plane which intersects the pivot axis and is parallel with the extension axis. The follower element may project from the extension plane towards the housing unit to engage the actuator.

The follower element may be configured to project through an opening in the housing unit when the cutting unit is in the closed position. This may permit the actuator to be wholly contained within the housing. This may also permit the cutting unit to closely confirm with a lower end of the housing, whilst permitting the follower element to project towards the housing by a sufficient distance to engage the actuator at any actuator position between the first and second actuator positions.

When the actuator is in the second actuator position there may be a radial actuator separation between the pivot axis and an actuation point on the actuator for engaging a contact surface of the follower element. The follower element may project from the extension plane so that the contact surface has a range of contact points for engaging the actuator between a proximal contact point towards the extension plane and a distal contact point towards the housing unit. The contact surface may be profiled so that, with the guard in the first guard position, a radial distance between the distal contact point and the pivot axis is equal to the radial actuator separation, thereby enabling contact with the actuator at the distal contact point. The contact surface may be profiled so that, with the guard in the first guard position, a radial distance between the pivot axis and the contact points on the contact surface reduces from the distal contact point towards the proximal contact point, so that pivoting movement of the cutting unit from the open position to the closed position causes the actuation point of the actuator to displace the follower element as it moves along the range of contact points on the contact surface.

The actuator may be rotatable between the first actuator position and the second actuator position. This may provide a simple means of translating a linear user input, for example from a slideable length-setting mechanism, to movement of the guard relative the blade carrier.

The guard and follower element may be constrained to move together along an extension axis. The actuator may have an actuation point for engagement with the follower element which is configured to trace an arcuate path between the first actuator position and the second actuator position so that the actuation point has a variable position along a projection axis perpendicular to the extension axis when the cutting unit is in the closed position. The follower element may have a contact surface for engagement with the actuation point of the actuator. The contact surface may have an extent along the projection axis to accommodate the variable position of the actuation point along the projection axis. Accordingly, the follower element may provide a simple and inexpensive means of translating the arcuate motion of the actuator to linear motion of the guard.

The housing unit may comprise a length-setting mechanism which is configured to lock movement of the actuator. The length-setting mechanism may be configured to selectively release the actuator for movement between actuator positions. The length-setting mechanism may therefore resist movement of the actuator during pivoting movement of the cutting unit from the open position to the closed position.

The cutting unit may be detachably attachable to the housing unit. Accordingly, cutting units may be easily replaced and maintained.

The cutting unit and the housing unit may have cooperating attachment points which define a pivot axis for pivoting movement of the cutting unit relative the housing unit.

The invention may comprise any combination of the features and/or limitations referred to herein, except combinations of such features as are mutually exclusive.

BRIEF DESCRIPTION OF THE DRAWINGS

Embodiments of the invention will now be described, by way of example, with reference to the accompanying drawings, in which.

DETAILED DESCRIPTION OF EMBODIMENTS

Figure 1:
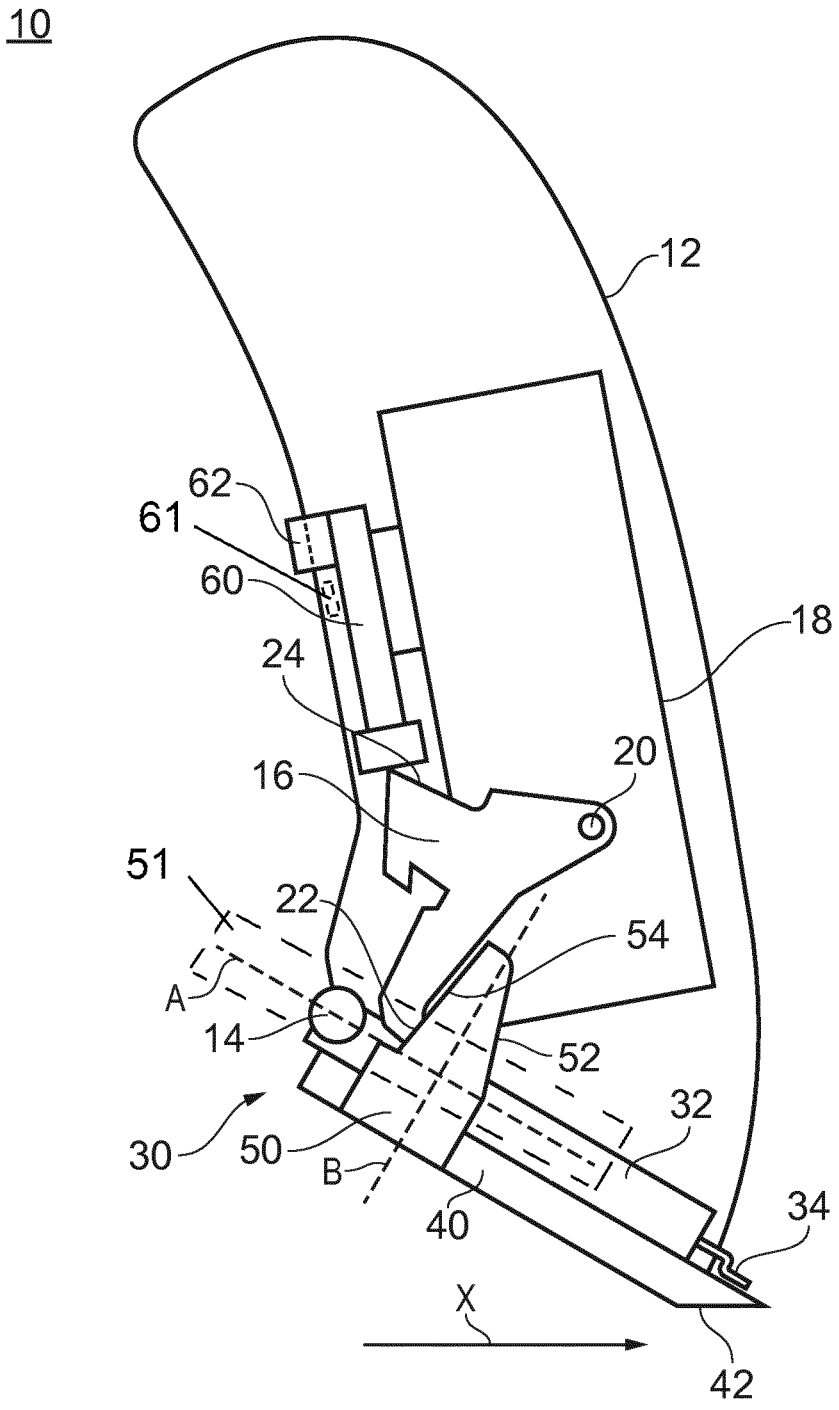
FIG. 1 schematically shows a cross-sectional view of a cutting device.

FIG. 1 shows a cutting device 10 comprising a housing unit 12 and a cutting unit 30 pivotable coupled to the housing unit 12 at a pivot 14. In this example, the cutting unit 30 and the housing unit 12 have cooperating attachment points which are detachable attachable at the pivot 14 to define a pivot axis for pivoting movement of the cutting unit 30 relative the housing unit 12. In other examples the cutting unit 30 may be provided together with the housing unit 12 such that they are not intended to be detached by a user (i.e. they are effectively permanently attached).

As shown schematically in FIG. 1, the housing unit 12 comprises an actuator 16 and a support 18 to which the actuator 16 is mounted. In this example, the actuator 16 is rotatable relative the housing unit 12 from a first actuator position corresponding to a shortest cutting length of the cutting unit 30 to a second actuator position corresponding to a longest cutting length of the cutting unit 30, as will be described in detail below with respect to FIG. 3.

In this example, the actuator 16 is generally in the form of a lever rotatable about an actuator pivot 20 on the support 18. The actuator has a first arm extending from the actuator pivot 20 to an actuation point 22 for engaging the cutting unit 30, as will be described below. In this example, the first arm is substantially elongate with a head that projects in the direction of rotating motion to the second actuator position (i.e. anti-clockwise in FIG. 1) to define the actuation point.

In this example, the actuator 16 further comprises a second arm extending from the actuator pivot 20 to a drive input point 24 for receiving a driving force to move the actuator 16 from the first actuator position to the second actuator position. For example, the drive input point 24 may be driven by a length-setting mechanism of the housing unit 12. By way of example, the length-setting mechanism of the cutting device 10 of FIG. 1 has a slider 60 slidably mounted to the support 18 of the housing unit 12 and configured to slide between first and second positions to cause corresponding sliding movement of the actuator 16 from the first actuator position to the second actuator position. The slider 60 is in the form of a piston having a head which engages the drive input point 24 of the slider. A slide button 62 protrudes from a side of the piston and through a slot in the wall of the housing unit 12. In this example, the slider 60 is mounted to the support 18 so that, in order to slide the slider 60, the button 62 is depressed to press the slider 60 towards the support 18 to release a latch 61. When the button 62 is released, it returns from the depressed configuration under a biasing force so that the latch 61 re-engages, thereby locking the slider 60 in position and preventing inadvertent sliding movement.

FIG. 1 shows the cutting unit 30 in a closed position in which it extends along and is retained against a lower end of the housing unit 12. For example, in the closed position the cutting unit 30 may be retained against the housing unit 12 by attachment at the pivot 14, and by one or more other fasteners, such as mutually engaging snap-fit formations on the cutting unit 30 and the housing unit 12 respectively. In the closed position, the cutting unit 30 may align with a blade drive of the housing unit 12 for driving reciprocating motion of a cutting blade of the cutting unit.

The cutting unit 30 comprises a blade carrier 32 configured to detachably attach to the housing unit 12 at the pivot 14 and extend along the lower end of the housing 12 in the closed position. The blade carrier 32 holds a blade 34 which extends from a forward end of the blade carrier 32 (the right side as shown in FIG. 1). In this example, the blade 34 has a toothed cutting edge configured for transverse reciprocation along a transverse axis parallel with a pivot axis of the pivot 14.

The cutting unit 30 further comprises a guard 40 coupled to the blade carrier 32 so that it is slideable relative the blade carrier 32 along an extension axis A (the extension axis A is shown in FIG. 1 as intersecting the pivot 14). As shown in FIG. 1, in this example the guard 40 extends along a lower side of the blade carrier 32. It has a squat substantially cuboidal body which is chamfered on its lower side to define a forward tip that protrudes forwardly from the blade carrier 32. The guard 40 has a substantially planar upper blade-facing surface which faces and engages the cutting blade 34 to define a cut location of the cutting unit.

The forward tip of the guard 40 has a guard contact surface 42 for engaging skin of a user, which is inclined with respect to the upper blade-facing surface (and with respect to the lower blade-facing surface), for example at an angle of between 15 and 40°. In this particular example, the guard contact surface 42 is inclined with respect to the blade-facing surface at an angle of approximately 30°.

The guard contact surface 42 is substantially planar and is for engaging skin of a user during cutting. When the guard contact surface 42 engages skin of a user, a cutting length of the cutting unit 30 is equal to the distance between the guard contact surface 42 and the cut location along an axis perpendicular to the guard contact surface 42.

As the guard 40 is slideable along the extension axis A, the cutting length is variable. FIG. 1 shows the guard in a first guard position corresponding to a shortest cutting length of the cutting unit. In this example, the guard 40 is biased to the first guard position, for example by a spring 41 acting between the blade carrier 32 and the guard 40 (or the follower element, as will be described below), or any suitable biasing means. There may be a stop acting between the guard and the blade carrier which defines the first guard position to which the guard is biased.

By biasing the guard to a predetermined position relative the blade carrier 32 (and thereby the blade 34), the relative position of the guard and the blade 34 may be set with relatively high accuracy. This accuracy may be relatively high in comparison with guard positions away from the biased position, which may depend on manufacturing tolerances of the various components along the transmission between the user input (e.g. a user-engageable slider) and the guard, such as the actuator, follower element, blade carrier, blade and the guard itself. In contrast, the predetermined position may be determined, for example, by simple abutment of the guard with a stop on the blade carrier 32, which directly determines the relative position of the guard and the blade carrier 32, and thereby the blade 34.

In this example, as the guard 40 is biased to the first guard position corresponding to the shortest cutting length of the cutting unit, the shortest cutting length may be set with relatively high accuracy. This may be advantageous as the shortest cutting length may have the lowest margin for error. In other words, an absolute error would translate into a higher percentage error for the shortest cutting length than a longest cutting length.

The cutting unit 30 further comprises a follower element 50 which is configured to engage the actuator 20 of the housing unit 12 to drive sliding movement of the guard 40 relative the blade carrier. In this example, the follower element 50 is fixedly attached to the guard 40 so that the guard 40 and follower element 50 are constrained to move along the extension axis A together. The follower element 50 may be coupled to the guard 40 in any suitable way. For example, the follower element 50 may be clipped to the guard 40, may engage cooperating formations of the guard 40 (for example by a snap-fit connection), or may be coupled to the guard by a mechanical fastener, such as a bolt.

As shown in FIG. 1, the follower element 50 has a contact member 52 which protrudes from a body of the follower element 50 towards the housing unit 12. In this example, the follower element is configured to project through an opening in the housing unit when the cutting unit is in the closed position. The projection of the follower element 50 will be described with reference to an extension plane 51 which intersects the pivot axis of the pivot 14 and is parallel with the extension axis A. In the orientation shown in FIG. 1, the extension plane is coincident with the extension axis A. In this example, the contact member 52 projects from the extension plane so that it has an extent along a projection axis B (i.e. an axis normal to the extension plane) towards the housing unit.

The pivot axis of the pivot 14, the extension axis A and the projection axis B are three orthogonal axes which are fixed with respect to the cutting unit 30. Together with the extension plane, they are used in the following description to describe geometric relationships between components of the cutting unit 30, and also of the housing.

The contact member 52 projects from the extension plane towards the housing unit 12 to define a contact surface 54 for engaging the actuator 20. In this particular example, the contact surface 54 is generally planar and is inclined relative a plane normal to the extension axes A by an acute angle, for example approximately 10°. In other words, a normal axis of the contact surface is inclined with respect to the extension axis by an acute angle (for example approximately 10°) and lies in a plane normal to the pivot axis. In other examples, the contact surface 54 may be curved. Interaction between the contact surface 54 and the actuation point 22 of the actuator 16 will be described in detail below.

Figure 2:
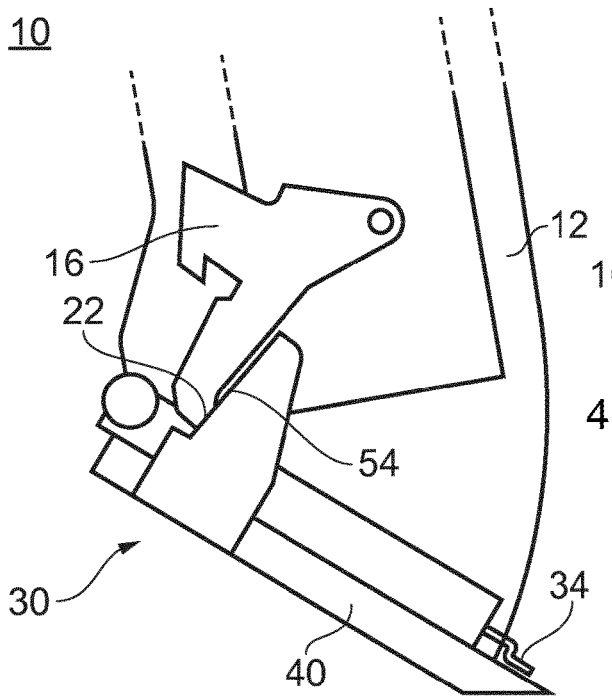
FIGS. 2 and 3 show the cutting device with the guard of the cutting unit in a first position corresponding to a shortest cutting length (FIG. 2), and a second position corresponding to a longest cutting length (FIG. 3), respectively.
Figure 3:
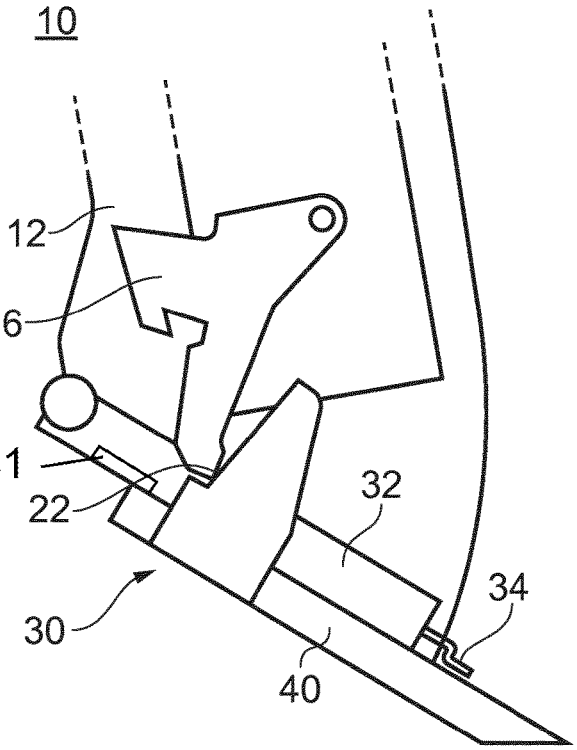

FIGS. 2 and 3 show partial cross-sectional views of the cutting device 10 with the guard 40 in a first guard position corresponding to a shortest cutting length of the cutting unit 30 (FIG. 3), and a second guard position corresponding to a longest cutting length of the cutting unit 30 (FIG. 3).

The cutting unit 30 has a range of cutting lengths, and the first and second guard positions correspond to two extremes of the range of cutting lengths: i.e. a shortest cutting length and a longest cutting length.

As shown by comparison of FIGS. 2 and 3, in use the actuator 16 is rotated about the actuator pivot 20 (in an anti-clockwise position as shown in the drawings) to move from a first actuator position corresponding to the shortest cutting length to a second actuator position corresponding to the longest cutting length.

In the first actuator position the actuation point 22 of the actuator engages the contact surface 54 of the follower element 50 at a contact point.

The pivoting movement of the actuator causes the actuation point 22 on the actuator to trace an arcuate path, such that the actuation point moves along the extension axis A whilst also moving along the projection axis. Accordingly, the actuation point 22 moves along the contact surface 54 to engage at different contact points on the contact surface as it traces the arcuate path.

As the actuator 16 moves towards the second actuator position it causes the follower element 50, and thereby the guard 40, to move along the extension axis so that the guard 40 reaches a second guard position as shown in FIG. 3, corresponding to the longest cutting length.

In use, the actuator 16 can return from the second actuator position to the first actuator position (or to any position therebetween). In this example, the guard is biased to the first guard position corresponding to the shortest cutting length, and so the guard 40 moves back from the second guard position towards the first guard position under action of the biasing force, as permitted by returning movement of the actuator 16.

FIGS. 4-7 show various configurations of the cutting unit 30 relative the housing unit (only the actuator 16 is shown for clarity) as the cutting unit 30 moves from an open position to a closed position, with the actuator in the second actuator position.

Figure 4:
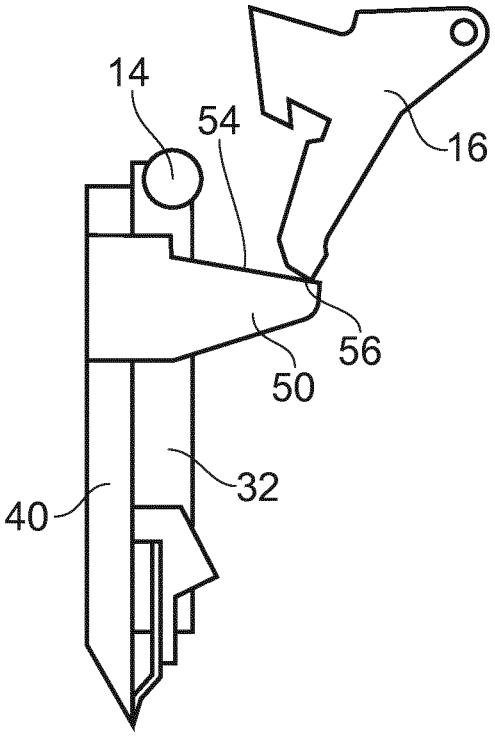
FIGS. 4-7 show the cutting device with the cutting unit at various positions between an open position (FIG. 4) and a closed position (FIG. 7)

By way of example, in use the cutting device 10 may reach the configuration shown in FIG. 4 from the configuration shown in FIG. 3 (i.e. in which the actuator and guard are in the respective second positions corresponding to the longest cutting length) by pivoting the cutting unit 30 relative the housing unit 12 from the closed position to the open position (i.e. away from the housing unit 12 about the pivot 14).

As described above, the housing unit comprises a length-setting mechanism 60 which is configured to lock movement of the actuator 16 and selectively release the actuator for movement. Accordingly, such pivoting movement of the cutting unit 30 from the closed position to the open position does not cause the actuator to move to a different actuator position. The actuator 16 therefore remains in the second actuator position.

Similarly, detachment of the cutting unit 30 would not cause the actuator to move to a different actuator position.

In contrast, the guard 40 is biased to the first guard position and so it returns towards the first guard position as the pivoting movement of the cutting unit 30 from the closed position to the open position results in the actuator ceasing to engage the follower element.

As will be described in detail below, the cutting device 10 is configured so that the cutting unit 30 can be pivoted from the open position as shown in FIG. 4 to the closed position (as shown in FIGS. 1-3, 7) so that the actuator 16 engages the follower element for moving the guard between the first and second guard positions, irrespective of the starting position of the actuator element before such pivoting.

When the actuator 16 is in the first actuator position as shown in FIGS. 1 and 2, the cutting unit 30 can be simply pivoted back and forth between the closed position and the open position, as the actuation point 22 in the first actuator position is positioned to engage the follower element 50 when the guard is in the first guard position.

A more complex interaction occurs when the actuator 16 is in the second actuator position as shown in FIGS. 4-7, and the cutting unit 30 is pivoted from the open position (as shown in FIG. 4) to the closed position, as will be described below.

As shown in FIG. 4, with the actuator 16 in the second actuator position corresponding to the longest cutting length, there is a radial actuator separation between the pivot 14 and the actuation point 22 on the actuator 16. The radial actuator separation is fixed whilst the actuator 16 is locked in position.

Although the guard 40 is in the first guard position corresponding to the shortest cutting length, the follower element 50 projects from the extension plane so that the contact surface 54 has a range of contact points for engaging the actuator, from a proximal contact point proximal to the extension plane to a distal contact point towards the housing unit. As shown in FIG. 1, when the guard 40 is in the first guard position, the follower element 50 is positioned relative the pivot 14 so that there is a distal contact point 56 towards the housing unit 12 (i.e. towards a tip of the follower element away from the extension plane) which is radially spaced from the pivot axis by an amount equal to the radial separation. Accordingly, when the cutting unit 30 is in the open position as shown in FIG. 4 and the actuator 16 is in the second actuator position, the actuation point 22 of the actuator engages the contact surface 54 of the follower element 54 at the distal contact point 56.

Figure 7:
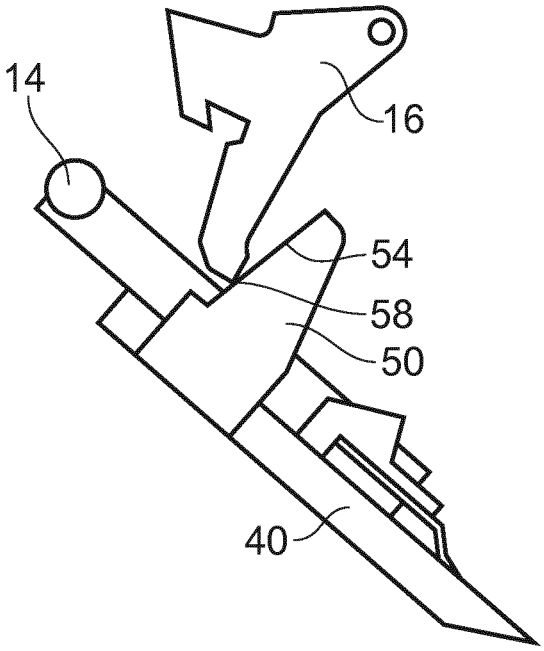

In preparation for use, the cutting unit 30 is pivoted from the open position of FIG. 4 to the closed position as shown in FIG. 7, whereby the actuator 16 acts on the follower element 50 to drive the guard 40 to the guard position, as will be described below.

As will be appreciated, pivoting motion of the cutting unit 30 about the pivot 14 towards the housing 12 (for example, by action of a user) will tend to move the contact surface 54 of the follower element along the actuation point 22 of the actuator 16. Further, as described above, when the guard 40 is in the guard position the distal contact point 56 is radially spaced apart from the pivot axis at the pivot 14 by a distal equal to the separation between the pivot axis and the actuation point.

The contact surface 54 is configured so that the radial distance between the pivot axis and other contact points on the contact surface reduces from the distal contact point 56 towards the extension plane, or towards a proximal contact point proximal to the extension plane. Accordingly, as the contact surface 54 is rotated past the actuation point of the actuator, the follower element 50 is caused to move forward along the extension axis to maintain the radial distance between the pivot axis and a contact point on the contact surface.

Figure 5:
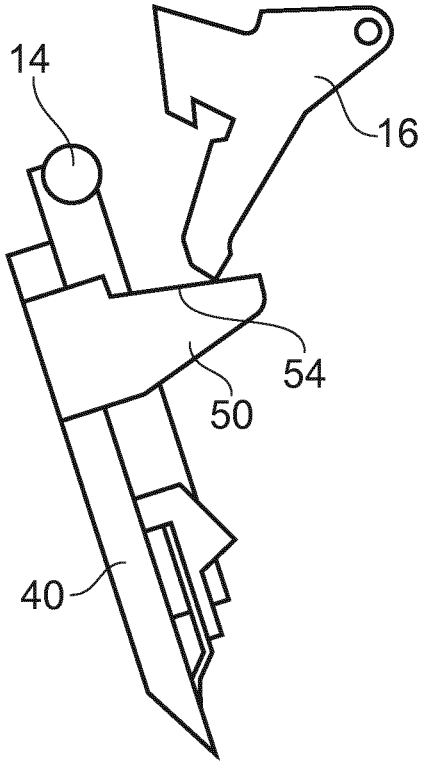
Figure 6:
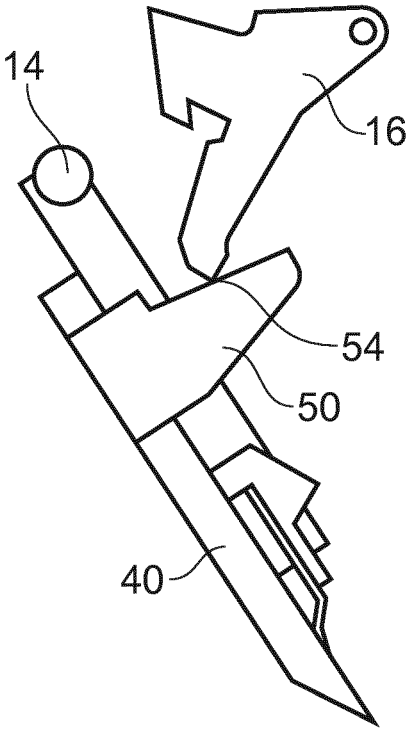

FIGS. 5 and 6 show the cutting unit 30 at intermediate positions relative the actuator 16 between the open position (of FIG. 4) and the closed position (of FIG. 7) as the actuation point 22 of the actuator moves along the contact surface 54 of the follower element, thereby causing the follower element to move forwardly along the extension axis relative the blade carrier 32. When the cutting unit 30 reaches the closed position as shown in FIG. 7, the actuation point 22 of the actuator 16 engages the proximal contact point 58. The movement of the follower element 50 drives corresponding movement of the guard 40 from the first guard position to the second guard position, as shown in FIG. 7.

Figure 8:
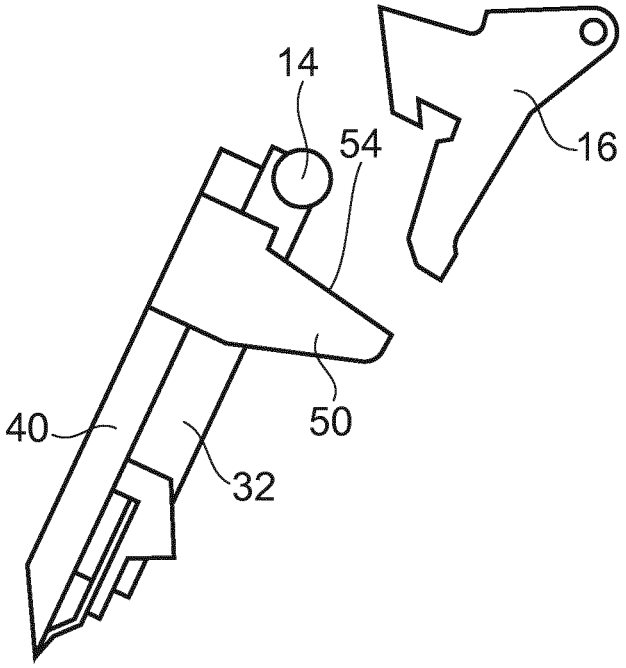
FIG. 8 shows the cutting device with the cutting unit at an open position.

Whilst the cutting unit is illustrated in FIG. 4 in an open position in which an actuation point of the actuator engages the contact surface of the follower element, in other open positions there may be no such engagement. For example, the cutting unit may be in the open position shown in FIG. 4, but the actuation element may be at the first actuator position or an intermediate actuator position between the first and second actuator positions. Further, as shown in FIG. 8, the cutting unit 30 may be pivotable to an open position in which, with the guard 40 in the first guard position and the actuator 16 in the second actuator position, the actuation point 22 of the actuator 16 is separated from the contact surface 54 of the follower element 50.

Although an example has been described in which the cutting unit pivots to the closed position when the actuator is in the second actuator position corresponding to an extreme of the cutting length range of the cutting unit (in particular, a longest cutting length), it will be appreciated that the cutting unit may equally be pivoted to the closed position when the actuator is in the first actuator position or an intermediate actuator position (i.e. any actuator position corresponding to a cutting-length chosen by a user setting the length-setting mechanism).

When the actuator is in an intermediate actuator position corresponding to an intermediate cutting length, the actuator first engages the contact surface of the follower element during pivoting movement when the cutting unit is at an open position which is relatively closer to the housing unit than that described and shown with respect to FIG. 4. The actuation point of the actuator first engages the contact surface of the follower element at an intermediate contact point between the distal contact point and the proximal contact point described herein. Similarly, the follower element and guard are driven to positions corresponding to the intermediate cutting length.

While the invention has been illustrated and described in detail in the drawings and foregoing description, such illustration and description are to be considered illustrative or exemplary and not restrictive; the invention is not limited to the disclosed embodiments. Various alternative examples are discussed throughout the detailed description.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A hair cutting device comprising a housing unit and a cutting unit, the housing unit comprising:

a length-setting mechanism, and an actuator for varying a cutting length setting of the cutting unit within a cutting length range, the actuator being moveable by the length-setting mechanism between a first actuator position corresponding to a first extreme cutting length of the cutting length range, and a second actuator position corresponding to a second extreme cutting length of the cutting length range;

the cutting unit configured to pivot relative to the housing unit between a closed position for a cutting operation and an open position;

the cutting unit comprising:

a blade carrier carrying a cutting blade and pivotally coupled to the housing unit at a pivot, the blade carrier being pivotally movable about a pivot axis through the pivot for pivotally moving the cutting unit about the pivot axis;

a guard moveable along the blade carrier to change a distance between the cutting blade and a tip of the guard for setting the cutting length setting of the cutting unit within the cutting length range, wherein the guard is moveable between a first guard position corresponding to the first extreme cutting length and a second guard position corresponding to the second extreme cutting length;

a spring configured to bias the guard to the first guard position; and a follower element attached to the guard and configured to cooperate with the actuator so that, with the cutting unit in the closed position, movement of the actuator from the first actuator position to the second actuator position drives the follower element to move the guard from the first guard position to the second guard position;

wherein the follower element is configured to cooperate with the actuator so that, when the actuator is in the second actuator position, pivoting movement of the cutting unit from the open position to the closed position causes the actuator to drive the follower element to move the guard from the first guard position to the second guard position.

2. The cutting device according to claim 1, wherein the second guard position corresponding to the second extreme cutting length is a maximum cutting length setting of the cutting unit where the distance between the cutting blade and a tip of the guard is maximum.

3. The cutting device according to claim 1, wherein the follower element is configured to cooperate with the actuator so that, when the actuator is in the second actuator position, pivoting movement of the cutting unit from the open position to the closed position causes an actuation point of the actuator to engage and move along a contact surface of the follower element as the cutting unit moves towards the closed position, and wherein the contact surface is configured so that said movement of the actuation point along the contact surface drives the follower element to move the guard from the first guard position to the second guard position.

4. The cutting device according to claim 1, wherein the follower element is configured to move together with the guard relative to the blade carrier along a longitudinal axis of the guard.

5. The cutting device according to claim 4, wherein the pivot axis is orthogonal to the longitudinal axis of the guard.

6. The cutting device according to claim 5, wherein an extension plane intersects the pivot axis and is parallel with the longitudinal axis, and wherein the follower element projects from the extension plane towards the housing unit to engage the actuator.

7. The cutting device according to claim 6, wherein the follower element is configured to project through an opening in the housing unit when the cutting unit is in the closed position.

8. The cutting unit according to claim 6, wherein when the actuator is in the second actuator position there is a radial actuator separation between the pivot axis and an actuation point on the actuator for engaging a contact surface of the follower element;

wherein the follower element projects from the extension plane so that the contact surface has a range of contact points for engaging the actuator between a proximal contact point towards the extension plane and a distal contact point towards the housing unit;

wherein the contact surface is profiled so that, with the guard in the first guard position, a radial distance between the distal contact point and the pivot axis is equal to the radial actuator separation, thereby enabling engagement with the actuator at the distal contact point; and wherein the contact surface is profiled so that, with the guard in the first guard position, a radial distance between the pivot axis and the contact points on the contact surface reduces from the distal contact point towards the proximal contact point, so that pivoting movement of the cutting unit from the open position to the closed position causes the actuation point of the actuator to displace the follower element as the follower element moves along the range of contact points on the contact surface.

9. The cutting device according to claim 1, wherein the actuator is rotatable about an actuator pivot on a support of the housing unit between the first actuator position and the second actuator position.

10. The cutting device according to claim 9, wherein the guard and the follower element are constrained to move together along a longitudinal axis of the guard;

wherein the actuator has an actuation point for engagement with the follower element which is configured to trace an arcuate path between the first actuator position and the second actuator position so that the actuation point has a variable position along a projection axis perpendicular to the longitudinal axis when the cutting unit is in the closed position; and wherein the follower element has a contact surface for engagement with the actuation point of the actuator, and wherein the contact surface has an extent along the projection axis to accommodate the variable position of the actuation point along the projection axis.

11. The cutting device according to claim 1, wherein the length-setting mechanism includes a latch configured to lock movement of the actuator, and is configured to selectively release the actuator for movement between the first and second actuator positions.

12. The cutting device according to claim 1, wherein the blade carrier is detachably attachable to the housing unit.

13. The cutting device according to claim 12, wherein the blade carrier and the housing unit have cooperating attachment points at the pivot for the pivoting movement of the cutting unit relative the housing unit.

14. A hair cutting device comprising a housing and a cutter, the housing comprising:

an actuator for varying a cutting length setting of the cutter within a cutting length range, the actuator being moveable between a first actuator position corresponding to a first extreme cutting length of the cutting length range, and a second actuator position corresponding to a second extreme cutting length of the cutting length range;

the cutter comprising:

a blade carrier carrying a cutting blade and pivotally coupled to the housing at a pivot, the blade carrier being pivotally movable about a pivot axis through the pivot for pivotally moving the cutter about the pivot axis;

a guard moveable along the blade carrier to change a distance between the cutting blade and a tip of the guard for setting the cutting length setting of the cutter within the cutting length range, wherein the guard is moveable between a first guard position corresponding to the first extreme cutting length and a second guard position corresponding to the second extreme cutting length;

a follower attached to the guard and configured to cooperate with the actuator so that, with the cutter in a closed position, movement of the actuator from the first actuator position to the second actuator position drives the follower to move the guard from the first guard position to the second guard position, wherein the follower is configured to cooperate with the actuator so that, when the actuator is in the second actuator position, pivoting movement of the cutter from an open position to the closed position causes the actuator to drive the follower to move the guard from the first guard position to the second guard position.

15. The hair cutting device of claim 14, further comprising a spring configured to bias the guard to the first guard position, wherein the cutter is configured to pivot relative to the housing between the closed position for a cutting operation and an open position for at least one of maintenance, cleaning and replacement of components of the cutter.

16. A hair cutting device comprising a housing and a cutter, the housing comprising:

an actuator for varying a cutting length setting of the cutter within a cutting length range, the actuator being moveable between a first actuator position corresponding to a first extreme cutting length of the cutting length range, and a second actuator position corresponding to a second extreme cutting length of the cutting length range;

the cutter comprising:

a blade carrier carrying a cutting blade;

a guard moveable along the blade carrier to change a distance between the cutting blade and a tip of the guard for setting the cutting length setting of the cutter within the cutting length range;

a spring configured to bias the guard to a first guard position corresponding to the first extreme cutting length; and a follower attached to the guard and configured to cooperate with the actuator to move the guard between the first guard position corresponding to the first extreme cutting length and a second guard position corresponding to the second extreme cutting length.

17. The hair cutting device of claim 16, wherein the follower is configured to cooperate with the actuator so that, when the actuator is in the second actuator position, pivoting movement of the blade carrier about a pivot axis from an open position to a closed position causes the actuator to drive the follower to move the guard from the first guard position to the second guard position, the pivot axis being through a pivot that pivotally couples the blade carrier to the housing.

18. A hair cutting device comprising a housing and a cutter, the housing comprising:

an actuator for varying a cutting length setting of the cutter within a cutting length range, the actuator being moveable between a first actuator position corresponding to a first extreme cutting length of the cutting length range, and a second actuator position corresponding to a second extreme cutting length of the cutting length range;

the cutter comprising:

a blade carrier carrying a cutting blade and pivotally coupled to the housing at a pivot, the blade carrier being pivotally movable about a pivot axis through the pivot for pivotally moving the cutter about the pivot axis;

a guard moveable along the blade carrier to change a distance between the cutting blade and a tip of the guard for setting the cutting length setting of the cutter within the cutting length range; and a follower attached to the guard and configured to cooperate with the actuator to move the guard between a first guard position corresponding to the first extreme cutting length and a second guard position corresponding to the second extreme cutting length, wherein the cutter is configured to pivot relative to the housing between a closed position for a cutting operation and an open position for at least one of maintenance, cleaning and replacement of components of the cutter.

* * * * *